United States Patent [19]

Sekiguchi

[11] Patent Number: 5,041,022

[45] Date of Patent: Aug. 20, 1991

[54] SOCKET WITH A LOCK

[75] Inventor: Shigemi Sekiguchi, Kiryu, Japan

[73] Assignee: Hosiden Electronics Co., Ltd., Osaka, Japan

[21] Appl. No.: 460,113

[22] PCT Filed: Sep. 20, 1989

[86] PCT No.: PCT/JP89/00951

§ 371 Date: May 3, 1990

§ 102(e) Date: May 3, 1990

[87] PCT Pub. No.: WO90/03671

PCT Pub. Date: Apr. 5, 1990

[30] Foreign Application Priority Data

Sep. 21, 1988 [JP] Japan ..... 63-124294[U]

[51] Int. Cl.[5] ..... H01R 13/639; H01R 13/648

[52] U.S. Cl. ..... 439/609; 439/353; 439/95

[58] Field of Search ..... 439/353, 607-610, 439/95

[56] References Cited

U.S. PATENT DOCUMENTS

| | | | |
|---|---|---|---|
| 4,493,525 | 1/1985 | Hall et al. | 439/610 |
| 4,548,455 | 10/1985 | Ezure | 439/152 |
| 4,637,669 | 1/1987 | Tajima | 439/609 |
| 4,842,555 | 6/1989 | Cosmos et al. | 439/353 |
| 4,894,026 | 1/1990 | Dixon et al. | 439/609 |
| 4,936,795 | 6/1990 | Kawai et al. | 439/607 |
| 4,938,714 | 7/1990 | Kawai et al. | 439/607 |
| 4,946,400 | 8/1990 | Kawai et al. | 439/609 |

FOREIGN PATENT DOCUMENTS

| | | |
|---|---|---|
| 56-78 | 1/1981 | Japan . |
| 61-80583 | 5/1986 | Japan . |
| 62-106482 | 7/1987 | Japan . |
| 62-15458 | 8/1987 | Japan . |

*Primary Examiner*—Paula A. Bradley
*Assistant Examiner*—Kevin J. Carroll
*Attorney, Agent, or Firm*—Pollock, Vande Sande and Priddy

[57] ABSTRACT

A socket with a lock, in which a plurality of socket contacts (13) are held in a body (11) of a resin material, the body has an annular groove (14) cut therein outside the contacts and a ring-shaped metal cover (15) is secured in the annular groove along its outer peripheral surface. The ring-shaped cover (15) has an engaging edge for locking use (16) and at least one inwardly protruding lug (17).

6 Claims, 2 Drawing Sheets

SOCKET WITH A LOCK

TECHNICAL FIELD

The present invention relates to a socket with a lock which is locked to the mating plug when the plug is put in the socket.

TECHNICAL BACKGROUND

A conventional round, small connector socket disclosed in U.S. Pat. No. 4,637,669 has an electromagnetic shield and relatively firmly holds the mating plug put therein, but since no locking mechanism is provided, the plug may sometimes come out of the socket when the plug cable is pulled inadvertently. In U.S. Pat. No. 4,548,455 (reissued as U.S. Pat. No. 32,864) there is disclosed a connector plug with a lock which is capable of preventing easy disengagement from the socket, but no proposal has been made of a socket with a lock which is suitable for use with an electromagnetically shielded connector plug with a lock.

DISCLOSURE OF THE INVENTION

An object of the present invention is to provide a socket with a lock which prevents easy, accidental unlocking therefrom of the mating plug and which is suitable for use with an electromagnetically shielded connector plug with a lock.

According to the present invention, a plurality of socket contacts are held in a body of a resin material, the body has an annular groove cut therein outside the contacts, and a ring-shaped metal cover is inserted in the annular groove along its outer peripheral surface. The cover has an engaging edge for locking use and inwardly protruding lugs.

When a plug with a lock is inserted into the socket with a lock, a projection on an elastic tongue of the plug is engaged with the engaging edge of the cover, by which the plug is locked to the socket. Even if a plug with no lock is put in the socket, it is sufficiently retained by the inwardly protruding lugs.

BEST MODE FOR CARRYING OUT THE INVENTION

Figure 1:
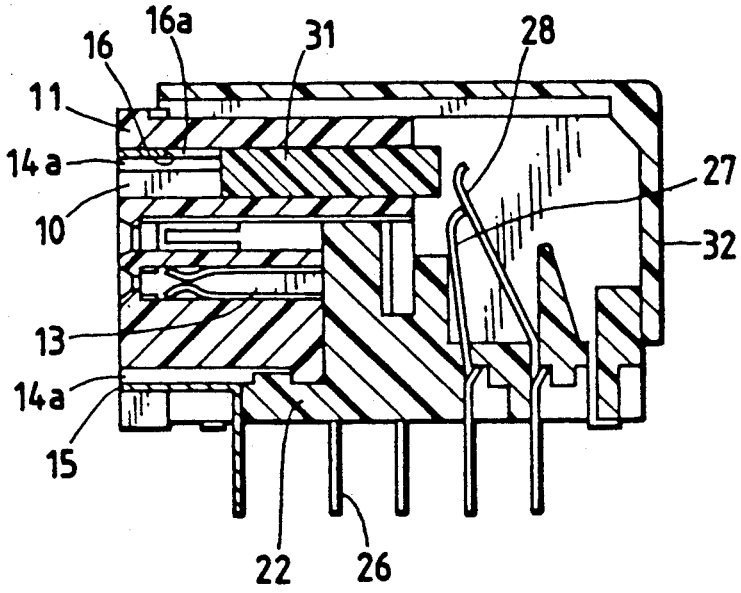
FIG. 1 is a sectional view illustrating an embodiment of the present invention.
Figure 2:
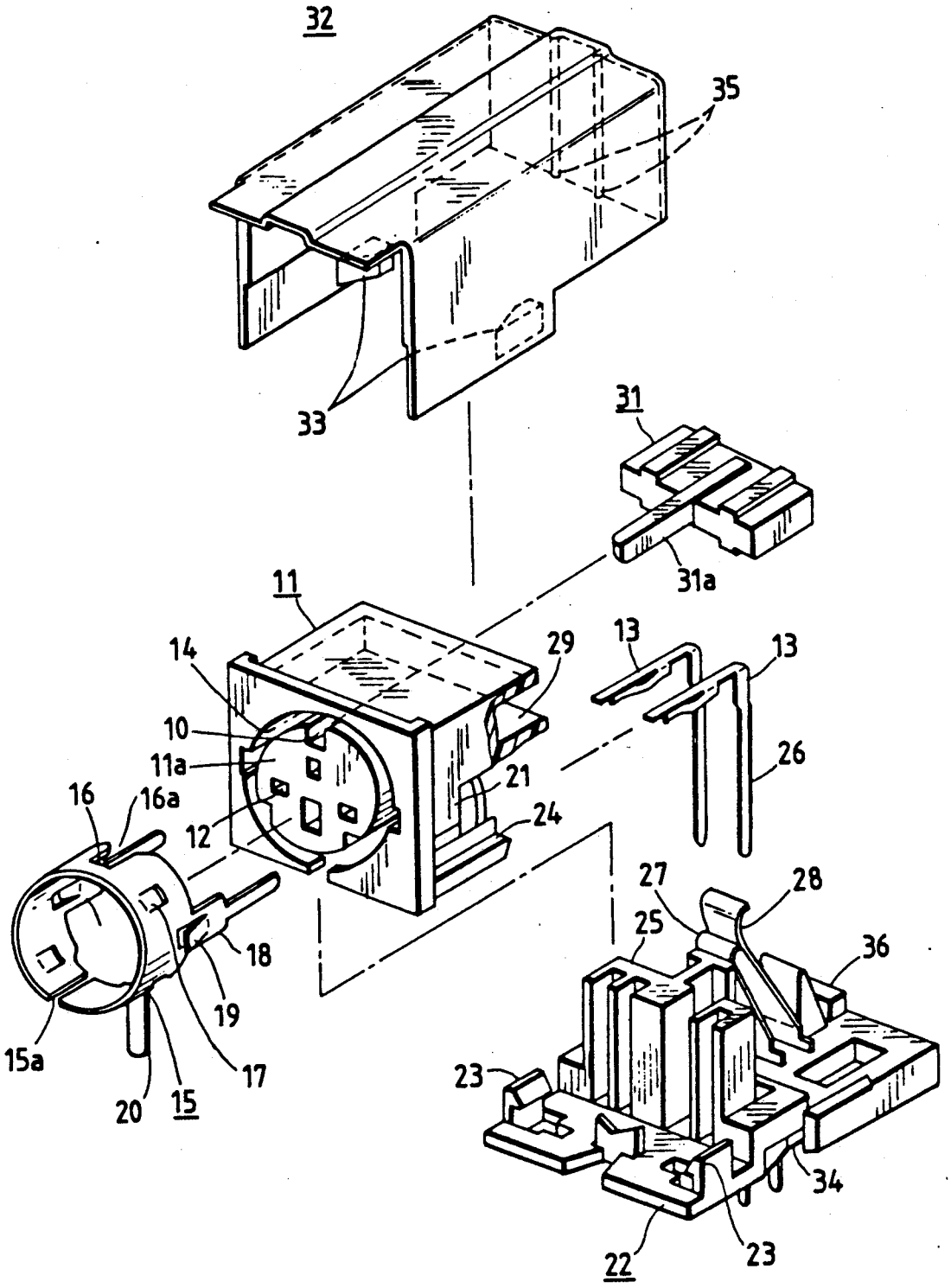
FIG. 2 is its exploded perspective view.

FIGS. 1 and 2 illustrate an embodiment of the present invention. A body 11 made of a resin material has a plurality of contact receiving holes 12 bored therethrough in the front-to-back direction, and each contact receiving hole 12 has disposed therein a socket contact 13. In the front of the body 11 there is cut an annular groove 14 outside the socket contacts 13, defining a columnar portion 11*a* of the body. The columnar portion 11*a* has a guide groove 10 cut in its outer peripheral surface and extending in its axial direction. The guide groove 10 guides a slidable support piece of the mating plug with a lock (not shown) when it is coupled with the socket of the present invention.

A metallic ring-shaped cover 15 is inserted into the annular groove 14 along its inner peripheral surface. The cover 15 is formed by cutting and stamping sheet metal and then rolling it into a ring-like form so that its two ends are opposite each other with a gap 15*a* defined therebetween, and in this example the angular position of the gap 15*a* is spaced apart from the guide groove 10. In this example the front marginal edge of the cover 15 is not tapered, and hence the cover has about the same outer diameter in its entirety. The outer diameter of the cover is a little smaller than the outer diameter of the annular groove 14 to such an extent that the cover does not play in the annular groove 14. Between the inner peripheral surface of the cover 15 and the outer peripheral surface of the columnar portion 11 there is defined a gap 14*a* (FIG. 1) into which a cylindrical metal cover of the mating plug (not shown) is inserted. The cover 15 has an engaging edge 16 for locking use, which lies above the groove 10. In this example a slot 16*a* of about the same width as the guide groove 10 is cut into the cover 15 to a predetermined depth from its rear edge to form the engaging edge 16 at the forward end of the slot 16*a*. When the mating plug with a lock is inserted into the socket of the present invention, a projection of an elastic tongue of the mating plug is engaged with the engaging edge 16 and at the same time a slidable support piece (not shown) of the mating plug is guided by the groove 10 so that it slides between the elastic tongue and the bottom of the guide groove 10 and projects into the body 11, locking the projection of the elastic tongue and the engaging edge 16.

The cover 15 has lugs 17 slightly protruding inwardly thereof. The lugs 17 are shown to be provided at four places at equiangular intervals. When the aforementioned cylindrical metal cover of the mating plug is inserted in the gap 14*a* between the cover 15 and the columnar portion 11*a*, the lugs 17 rigidly contact the outer peripheral surface of the cylindrical metal cover so that it can be firmly grasped with the contact pressure. The cover 15 and the cylindrical metal cover of the mating plug surround contact portions of the contacts 13, electromagnetically shielding them. A pair of leg pieces 18 extend from the rear end of the cover 15 and each leg piece 18 has an outwardly protruding pawl 19 which projects out rearwardly of the body 11 from the annular groove 14. The pawls 21 of the leg pieces are each locked to a locking portion 21 on the back of the body 11 to prevent the cover 15 from falling off the body. Further, the cover 15 has a ground terminal 20 extending down from its rear end portion.

The socket of this embodiment is of the type that has built therein a switch and in which the body 11 has attached thereto a base 22 of a resin material. The base 22 has a pair of locking pieces 23 formed integrally therewith at the forward portion thereof, and the body 11 has guides 24 extending in the front-to-back direction along both sides of its lower portion for receiving the above-mentioned locking pieces which are pushed into engagement therewith from behind, by which the base 22 is mounted on the body 11. The base 22 has a guide wall 25 planted thereon at its intermediate portion, and terminals 26 extending from the rear ends of the contacts 13 at right angles thereto are guided by the guide wall 25 so that they project out of the bottom of the base 22.

Further, the base 22 has planted thereon a fixed contact piece 27 behind the guide wall 25 and a movable contact piece 28 behind the fixed contact piece. In the upper portion of the body 11 there is provided a plunger housing 29, which communicates with the guide groove 10 and the annular groove 14. When a plunger 31 is inserted into the plunger housing 29 from behind, a drive rod 31*a* of the plunger 31 is guided by the guide groove 10 into the annular groove 14. In this state the tip end portion of the drive rod 31*a* lies in the slot 16*a* of the cover 15. The rear end face of the plunger 31 is held in adjacent but spaced relation to the upper projecting portion of the movable contact piece 28. When the cylindrical metal cover of the mating plug is inserted into the annular groove 14, its front edge pushes back the tip of the drive rod 31*a* and hence the plunger 31 is moved back, by which the movable contact piece 28 is driven out of contact with the fixed contact piece 27.

The rear portion of the body 11, and the fixed contact piece 27 and the movable contact piece 28 which form the switch, are covered with a case 32. The case 32 has locking pawls 33 formed integrally therewith on the inner surfaces of its two side walls, and the locking pawls 33 are locked to recesses 34 made in the intermediate portion of the base 22 on both sides thereof, by which the case 32 is fixed to the body 11 and the base 22. On the inside of the rear panel of the case 32 there are formed a pair of vertically extending protrusions 35, between which a guide 36 provided at the rear end of the base 22 is firmly held to thereby prevent displacement (or slippage) of the case 32. While in this example the case 32 is formed by molding of resin, it may also be made of sheet metal to electromagnetically shield the switch portion.

As described above, according to the present invention, the cover 15 has the engaging edge 16 for locking use; so that when a plug with a lock is inserted into the socket, the locking projection of the plug engages with edge 16 to lock the plug to the socket, and accordingly, there is no fear of the plug coming out of the socket when the plug is pulled or vibrated. Even if a plug with no lock is used, the lugs 17 firmly hold it. Moreover, since the cover 15 is secured in the annular groove 14 with the outer peripheral surface of the cover mostly held in contact with the outer peripheral wall of the annular groove, the gap 14*a* for receiving the cylindrical metal cover of the mating plug can be designed relatively small. Accordingly, the mating plug put in the socket of the present invention has little play relative to the socket, and even if a bending stress is applied to the plug, the projection of its elastic tongue will not come out of the engaging edge 16.

What is claimed is:

1. A socket with a lock, comprising:

a body of a resin material having an annular groove formed therein, said annular groove defining and being located around a columnar portion of said body which holds therein a plurality of socket contacts, said columnar portion having an outer peripheral surface in which a guide groove extends axially of said columnar portion; and a ring-shaped metal cover inserted in said annular groove of said body to surround said columnar portion of said body, said cover having at least one inwardly protruding lug and also having a separate engaging edge which extends across said guide groove for locking use.

2. The socket with a lock according to claim 1 wherein said cover includes a rear end located within said annular groove, said engaging edge being formed by a slot cut into said cover from said rear end thereof.

3. The socket with a lock according to claim 2 wherein said slot has about the same width as said guide groove, said slot being substantially colinear with said guide groove and being located above said guide groove.

4. The socket with a lock according to claim 1 or 3, wherein said ring-shaped cover has a pair of ends that are spaced from one another to define a gap which is angularly spaced from said guide groove.

5. The socket with a lock according to claim 1, or 3, wherein said ring-shaped cover has about the same outer diameter over its entire length.

6. The socket with a lock according to claim 1, or 3 wherein a plurality of said lugs are provided in said cover at equiangular intervals.

* * * * *